US011999396B2

(12) United States Patent
Angierski et al.

(10) Patent No.: US 11,999,396 B2
(45) Date of Patent: Jun. 4, 2024

(54) AUTOMATED ON-VEHICLE CONTROL SYSTEM FOR A RAIL VEHICLE

(71) Applicant: SIEMENS MOBILITY GMBH, Munich (DE)

(72) Inventors: Andre Angierski, Berlin (DE); Christian Klier, Potsdam (DE)

(73) Assignee: Siemens Mobility GmbH, Munich (DE)

( * ) Notice: Subject to any disclaimer, the term of this patent is extended or adjusted under 35 U.S.C. 154(b) by 595 days.

(21) Appl. No.: 17/276,246

(22) PCT Filed: Sep. 11, 2019

(86) PCT No.: PCT/EP2019/074164
§ 371 (c)(1),
(2) Date: Mar. 15, 2021

(87) PCT Pub. No.: WO2020/053245
PCT Pub. Date: Mar. 19, 2020

(65) Prior Publication Data

US 2022/0032983 A1 Feb. 3, 2022

(30) Foreign Application Priority Data

Sep. 14, 2018 (DE) ..... 10 2018 215 697.2

(51) Int. Cl.
*B61L 23/00* (2006.01)
*B61L 15/00* (2006.01)
(Continued)

(52) U.S. Cl.
CPC ..... *B61L 27/04* (2013.01); *B61L 15/0072* (2013.01); *B61L 25/025* (2013.01); *B61L 2205/04* (2013.01); *B61L 2210/02* (2013.01)

(58) Field of Classification Search
CPC ..... B61L 23/00; B61L 27/04; B61L 15/00; B61L 25/02
See application file for complete search history.

(56) References Cited

U.S. PATENT DOCUMENTS 9,937,938 B2 4/2018 Chung et al.
2004/0234136 A1 11/2004 Zhu et al.
(Continued)

FOREIGN PATENT DOCUMENTS

AU 2013205978 A1 12/2013
CN 101374714 A 2/2009
(Continued)

OTHER PUBLICATIONS

Shenton R.: "Video Train Positioning" IRSE Australasia Technical Meeting, Mar. 18, 2011 (Mar. 18, 2011) pp. 1-8, XP0033029634.

*Primary Examiner* — Tan Q Nguyen
(74) *Attorney, Agent, or Firm* — Laurence A. Greenberg; Werner H. Stemer; Ralph E. Locher

(57) ABSTRACT

An automated on-vehicle rail vehicle control system has an on-vehicle set point value detection unit, an automated train operating system, a driving and braking unit, and additional sensors for detecting environment-related information. The on-vehicle set point value detection unit is configured to determine, based on on-vehicle positioning and map data as well as sensor data from the additional sensors, operative set point values for the control mode and the current driving mission of the rail vehicle. The automated train operating system is configured to generate driving and braking commands based on the set point values of the on-vehicle set point value detection unit. The driving and braking unit is configured to carry out traction and braking operations based on the driving and braking commands so determined. There
(Continued)

are also described a rail vehicle and a method for the automated control of a rail vehicle.

10 Claims, 4 Drawing Sheets

(51) Int. Cl.
*B61L 25/02* (2006.01)
*B61L 27/04* (2006.01)

(56) References Cited

U.S. PATENT DOCUMENTS

| | | | | |
|---|---|---|---|---|
| 2007/0219680 | A1 | 9/2007 | Kumar et al. | |
| 2011/0118899 | A1 | 5/2011 | Brooks et al. | |
| 2014/0330460 | A1 | 11/2014 | Schoonmaker et al. | |
| 2015/0008294 | A1 | 1/2015 | Desbordes et al. | |
| 2015/0268172 | A1 | 9/2015 | Naithani et al. | |
| 2018/0339719 | A1* | 11/2018 | Loughlin | B61L 27/04 |
| 2018/0370552 | A1* | 12/2018 | Puttagunta | B61L 23/34 |
| 2019/0100226 | A1 | 4/2019 | Baier et al. | |
| 2019/0154439 | A1* | 5/2019 | Binder | G01B 11/26 |

FOREIGN PATENT DOCUMENTS

| | | | |
|---|---|---|---|
| CN | 102686471 | A | 9/2012 |
| CN | 103465799 | A | 12/2013 |
| CN | 104149643 | A | 11/2014 |
| CN | 106627670 | A | 5/2017 |
| CN | 107533630 | A | 1/2018 |
| DE | 102009023704 | A1 | 10/2010 |
| DE | 102012215533 | A1 | 3/2014 |
| DE | 102015219690 | A1 | 4/2017 |
| DE | 102016220215 | A1 | 4/2018 |
| DE | 102017101505 | A1 | 7/2018 |
| WO | 2016022635 | A1 | 2/2016 |
| WO | 2016118672 | A2 | 7/2016 |
| WO | 2017162472 | A1 | 9/2017 |
| WO | 2018104454 | A2 | 6/2018 |
| WO | 2018104462 | A1 | 6/2018 |
| WO | 2018104477 | A1 | 6/2018 |

* cited by examiner

AUTOMATED ON-VEHICLE CONTROL SYSTEM FOR A RAIL VEHICLE

BACKGROUND OF THE INVENTION

Field of the Invention

The invention relates to an automated on-vehicle rail vehicle control system. The invention furthermore relates to a rail vehicle. In addition, the invention relates to a method for the automated control of a rail vehicle.

Rail vehicles have automation systems that are conventionally substantially based on an adaptation of the infrastructure, i.e. the network, in which the rail vehicle moves. With the aid of these systems, measures are taken to safeguard the course of the route against disruptive objects. For example, doors on platforms or sensors for monitoring track clearance in rail stations can be used for this purpose. There is also a significant external influence on the rail vehicles. For this purpose, fixed landmarks in the infrastructure define synchronization points. An automated driving operation is conventionally based on a train protection system with appropriate equipment on the vehicle and in the infrastructure. This type of automated train control always requires an adapted infrastructure to be provided outside the rail vehicles to be controlled. If this is not embodied on a route, autonomous driving is not possible on this route with conventional means.

DE 10 2017 101 505 A1 describes a method for optimizing a driving operation based on route- and position-related data as well as non-route-related data.

WO 2018/104 477 A1 describes a method for lane identification. An image recording unit is used to identify a lane.

Therefore, the object is to disclose an automated control system for a rail vehicle and a corresponding automated control method that require less effort and can be used more flexibly than conventional systems.

SUMMARY OF THE INVENTION

This object is achieved by an automated on-vehicle rail vehicle control system as claimed, a rail vehicle as claimed, and a method for the automated control of a rail vehicle as claimed.

The automated on-vehicle rail vehicle control system according to the invention has an on-vehicle setpoint value specification determination unit, an automated train operating system, a driving and braking unit and additional sensors for acquiring environmental information. The automated on-vehicle setpoint value specification determination unit, for example an automated on-vehicle setpoint value specification determination unit, is configured, on the basis of on-vehicle high-precision position determination and high-precision map data as well as sensor data from the additional sensors, to determine operative setpoint value specifications for the regulation mode and for the current driving mission of the rail vehicle. The driving mission comprises for example stops and stopping times that must be observed during the journey of a rail vehicle. On-vehicle position determination should be understood to be an infrastructure-independent position determination, wherein the sensor technology required for this is comprised by the rail vehicle.

The regulation mode comprises dynamic determination of braking and acceleration setpoints in order to move the vehicle according to the driving mission and the external environmental situation. The set route (see driving mission) results in a static speed profile. The regulation system must first set the target speed for the vehicle in compliance with these specifications. In addition, dynamic influences, such as, for example, light signal installations, other rail vehicles on the track or even potential obstacles on the route are included in the regulation.

The driving mission comprises a previously defined driving route and optionally schedule data relating to the time sequence. Hence, this is the driving task to be fulfilled by the vehicle. For example, the driving mission comprises the instruction to drive from A to B in compliance with a relative schedule. Herein, a journey should take place at the maximum possible speed and with a stopping time of X seconds. The high-precision position determination can be performed with technical components which, for example, determine a highly precise GPS position (corrected GPS). Furthermore, landmarks, such as, for example, overhead line masts, the course of the track, buildings, etc., serve as comparison points. In this context, the SLAM method is cited by way of example. These features are acquired by the environment sensors on the vehicle. For high-precision position determination, measurement data from these components is furthermore merged. It is possible to use high-precision GPS receivers, inertial sensors, a vehicle odometry system and environment sensors in a combination (merger) suitable for the rail vehicle.

The automated train operating system is configured to generate driving and braking commands on the basis of the setpoint specifications of the on-vehicle setpoint value specification determination unit.

Herein, compliance with a driving profile is taken into account at this level. This driving profile is based on the data for a current driving mission as well as the map data, which comprises information on maximum speeds and distances. It is also possible to determine a particularly energy-efficient driving profile in compliance with the boundary conditions of the current driving mission, such as, for example, defined driving times, etc.

The driving and braking unit is configured to carry out traction and braking operations on the basis of the driving and braking commands determined.

Advantageously, the automated operation of the rail vehicle does not require any adaptations to the route and route infrastructure because the automated on-vehicle rail vehicle control system according to the invention comprises all components necessary for automated operation. Furthermore, the on-vehicle arrangement of the components required for automated driving, preferably autonomous driving, also facilitates mixed operation of automated and manually controlled vehicles since there are no disruptive influences from infrastructural units that control the automated or also autonomous driving.

Another mode of operation is represented by the exchange of information between vehicles. Thus, for example, the vehicles can expand their sensory field of view by incorporating data from other rail vehicles or other vehicles into the journey.

The rail vehicle according to the invention has the automated on-vehicle rail vehicle control system according to the invention. The rail vehicle according to the invention shares the advantages of the automated on-vehicle rail vehicle control system according to the invention.

The method for the automated control of a rail vehicle according to the invention includes an on-vehicle determination of a position of the rail vehicle and an acquisition of environmental information about the environment of the rail vehicle. Furthermore, operative setpoint specifications are determined for the regulation mode and the driving mission of the rail vehicle on the basis of the position determined and high-precision map data. Driving and braking commands are determined on the basis of the setpoint specifications of the on-vehicle setpoint value specification determination unit by an automated train operating system. Finally, traction and braking operations are carried out on the basis of the driving and braking commands determined.

In addition to driving and braking commands, it is also possible to warn other traffic participants. In the simplest case, this can be done by means of a warning bell. However, it is also possible for direct feedback on current planning and driving maneuvers to be provided, for example with the aid of a light strip on the outside of the vehicle, which color-codes states.

Parts of the automated on-vehicle rail vehicle control system according to the invention can be predominantly embodied in the form of software components. This in particular relates to parts of the setpoint value specification determination unit and of the automated train operating system. However, in principle, particularly where particularly fast calculations are involved, these components can also to some extent be implemented in the form of software-supported hardware, for example FPGAs or the like. Likewise, for example if only a transfer of data from other software components is involved, the interfaces required can be embodied as software interfaces. However, they can also be embodied as hardware-based interfaces that are controlled by means of suitable software.

A partially software-based implementation has the advantage that computer systems already previously in use in rail vehicles, which could, for example, be part of an automated control system, for example an autonomous or semi-autonomous control system, can be upgraded in a simple manner by a software update in order to operate in the manner according to the invention. Insofar, the object is also achieved by a corresponding computer program product with a computer program which can be loaded directly into a memory device of such a computer system with program sections for executing all the steps of the method for the automated control of a rail vehicle when the computer program is executed in the computer system.

In addition to the computer program, such a computer program product can optionally comprise additional items, such as, for example, documentation and/or additional components, and also hardware components, such as, for example, hardware keys (dongles etc.) for using the software.

Transportation to the storage device of the computer system and/or for storage on the computer system can take place by means of a computer-readable medium, for example a memory stick, a hard disk or another kind of transportable or integrated data carrier on which the program sections of the computer program which can be read-in and executed by a computer unit are stored. For this purpose, the computer unit may, for example, have one or more interacting microprocessors or the like.

The dependent claims as well as the following description each contain particularly advantageous embodiments and developments of the invention. Herein, in particular the claims of one claim category can be developed analogously to the dependent claims of another claim category and the parts of the description thereof. In addition, it is also possible within the context of the invention for the different features of different exemplary embodiments and claims to be combined to form new exemplary embodiments.

In one preferred embodiment of the automated on-vehicle rail vehicle control system according to the invention, the on-vehicle setpoint value specification determination unit comprises one of the following sensors:

- a position determination unit, for example based on a satellite navigation system,
- an incremental odometer,
- an imaging system,
- inertial sensors.

Said sensors can preferably be used in combination. A combination of sensors enables deficits on individual sensor types to be compensated. For example, sliding and skidding effects occur with odometers and satellite-based position determination units experience inaccuracies when traveling through tunnels or wooded landscapes. The use of inertial sensors allows direction detection when passing switches.

In one embodiment of the automated on-vehicle rail vehicle control system according to the invention, the on-vehicle setpoint value specification determination unit comprises a comparison unit for comparing the acquired sensor information with a high-precision route map. Such a high-precision map enables exact identification of relevant route features for both the current position of the vehicle and the further course of a route to be assigned to a driving mission.

These relevant features comprised by the high-precision route may comprise at least some of the following information:

- the course of the route,
- signal positions,
- stop positions,
- branches.

Information on the course of the route also comprises values of gradients on inclines and values of curve radii relevant for the selection of speed or traction power.

In one embodiment of the automated on-vehicle rail vehicle control system according to the invention, a current specification as to how the rail vehicle is to be moved can be determined on the basis of the current local position, the driving mission and the stored map. The local position determined enables a current position of the rail vehicle to be determined on the stored map and the driving mission provides information on the stops on the journey which can likewise be identified on the stored map. Therefore, a route can be determined on the map and specifications for a driving operation of the rail vehicle can be defined on the basis of the relevant features occurring on this route.

Preferably, the information from the imaging system can be used to determine the following information:

- optical signal identification,
- perception of other traffic participants,
- perception of passengers at a stop in order to carry out the appropriate procedure at the stop.

Advantageously, the automated on-vehicle rail vehicle control system according to the invention can also perceive information from the environment and take it into account in the current driving profile. For this purpose, the automated on-vehicle rail vehicle control system is equipped with the additional sensors and evaluation units mentioned above. The environmental information acquired with the aid of said unit is processed together with the other sensor information to form setpoint value specifications for the automated train operating system. The setpoint value specifications can, for example, comprise speed specifications or values for speed regulation. The speed regulation can be performed with an automated system that defines a speed depending on determined position information and environmental information. Alternatively, it is also possible to determine in a current situation, on the basis of the environmental information as well as the position information, how far the rail vehicle is allowed to move in the current situation.

The invention is described again in more detail in the following with reference to the attached figures and with reference to exemplary embodiments, in which:

DETAILED DESCRIPTION OF THE INVENTION

Figure 1:
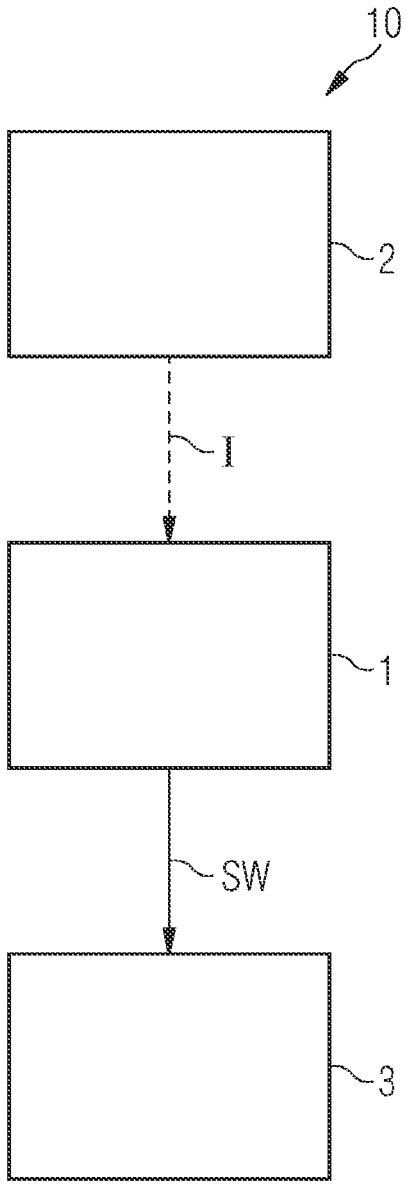
FIG. 1 shows a schematic representation of a conventional system for automated rail vehicle control.

FIG. 1 shows a schematic representation of a conventional system 10 for automated rail vehicle control. The system 10 for automated rail vehicle control has a plurality of safety systems 2 arranged in the infrastructure. For example, safety systems 2 comprise technical devices embodied to safeguard the route against disruptive objects. These comprise doors on platforms and sensors for monitoring track clearance. Furthermore, the safety systems comprise fixed stationary landmarks for synchronizing the rail vehicles as well as stationary safety devices for braking or stopping rail vehicles. Part of the system 10 for automated rail vehicle control also entails on-board automated control units 1, which issue driving and braking commands SW on the basis of the information I transmitted by the technical devices of the infrastructure, such as, for example, position data, stop signals and the like and forward them to traction and braking units 3. The traction and braking units 3 execute the driving and braking commands so that automatic control of the driving behavior of the rail vehicle is implemented.

Figure 2:
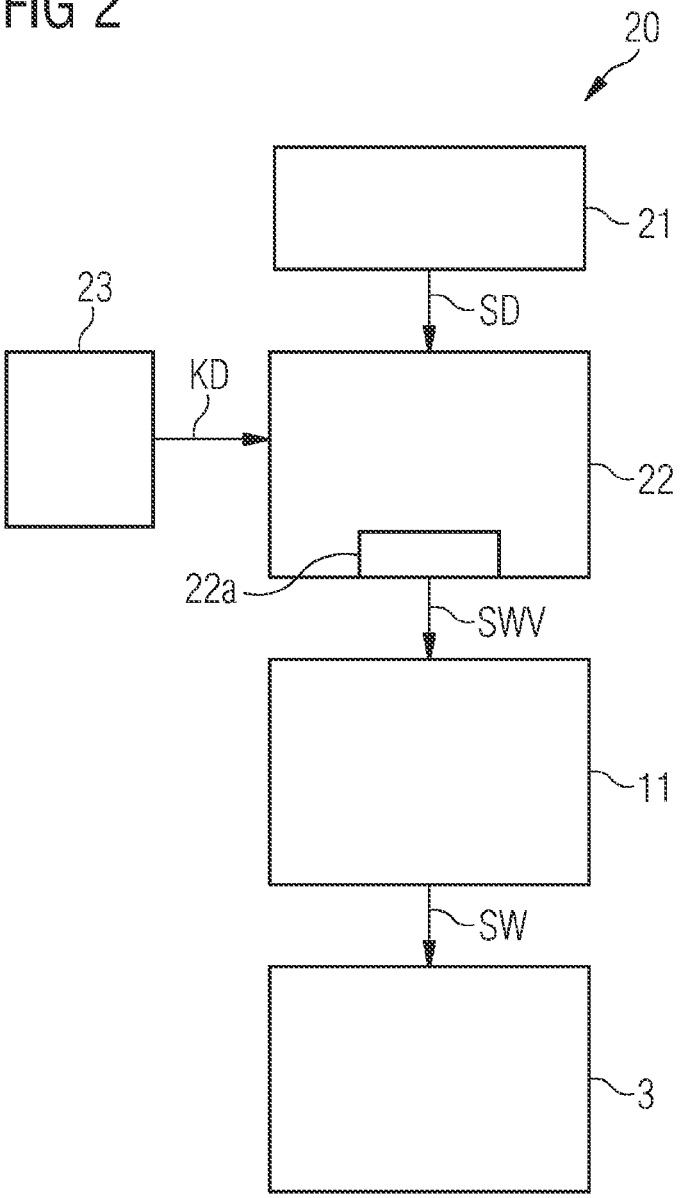
FIG. 2 shows a schematic representation of an automated on-vehicle rail vehicle control system according to a first exemplary embodiment of the invention.

FIG. 2 shows a schematic representation of an automated on-vehicle rail vehicle control system 20 according to a first exemplary embodiment of the invention. The on-vehicle rail vehicle control system 20 differs from conventional automatic control systems of rail vehicles in that it is implemented on the vehicle and does not require any communication with infrastructure installations.

An embodiment in combination with train protection components and infrastructure as well as the vehicle's own intelligence is likewise possible, but not necessary for an automated or autonomous driving function.

Like the conventional system 10 shown in FIG. 1, the automated on-vehicle rail vehicle control system 20 in FIG. 2 likewise has a system for actuation 3 of propulsion and braking. The actuation system 3 receives driving and braking commands SW from an automated train operating system 11. The automated train operating system 11 has an actuation and regulation function in the automated on-vehicle rail vehicle control system 20. Here, physical properties of the rail vehicle are taken into account. On the one hand, regulation technology implements driving and braking commands and, on the other, the automated train operating system 11 achieves compliance with a driving profile. Said actions are based on setpoint value specifications SWV. The setpoint value specifications SWV are generated by an on-vehicle setpoint value specification determination unit 22. The on-vehicle setpoint value specification determination unit 22 is connected to on-vehicle sensors 21 and a database 23. The on-vehicle sensors 21 have units for satellite navigation, incremental odometers, inertial sensors or imaging units. The sensor data SD determined by said sensors is used by the setpoint value specification determination unit 22 to determine the local position P of the rail vehicle. Furthermore, the setpoint value specification determination unit 22 has a comparison unit 22*a*, which in addition to the position P determined, receives map data KD from a database 23. Combining different types of sensors enables inaccuracies in individual systems to be compensated. For example, odometer pulse generators have sliding and skidding effects and shadowing effects occur with satellite signals when driving through tunnels or wooded landscapes. The use of inertial sensors allows direction detection when passing switches.

The comparison unit 22*a* uses the position P and the map data KD as the basis for carrying out a comparison, wherein information contained in the map, which is necessary for the driving operation and hence for the current setpoint value specifications SWV, is acquired and evaluated. This information can, for example, comprise the course of the route, signal positions, stop positions, branches and the like.

The journey of a rail vehicle follows a predefined driving mission, which is, for example, defined by a schedule. The current setpoint value specifications SWV, which indicate how far the rail vehicle is to be moved, are determined on the basis of the current local position P, the predefined driving mission and the map data KD, more precisely, the route of the driving mission stored in the map data KD. As already mentioned, the setpoint value specifications determined are transmitted to the automated train operating system 11, which uses them as the basis for generating driving and braking commands SW with which the actuation 3 of propulsion and braking is controlled.

Figure 3:
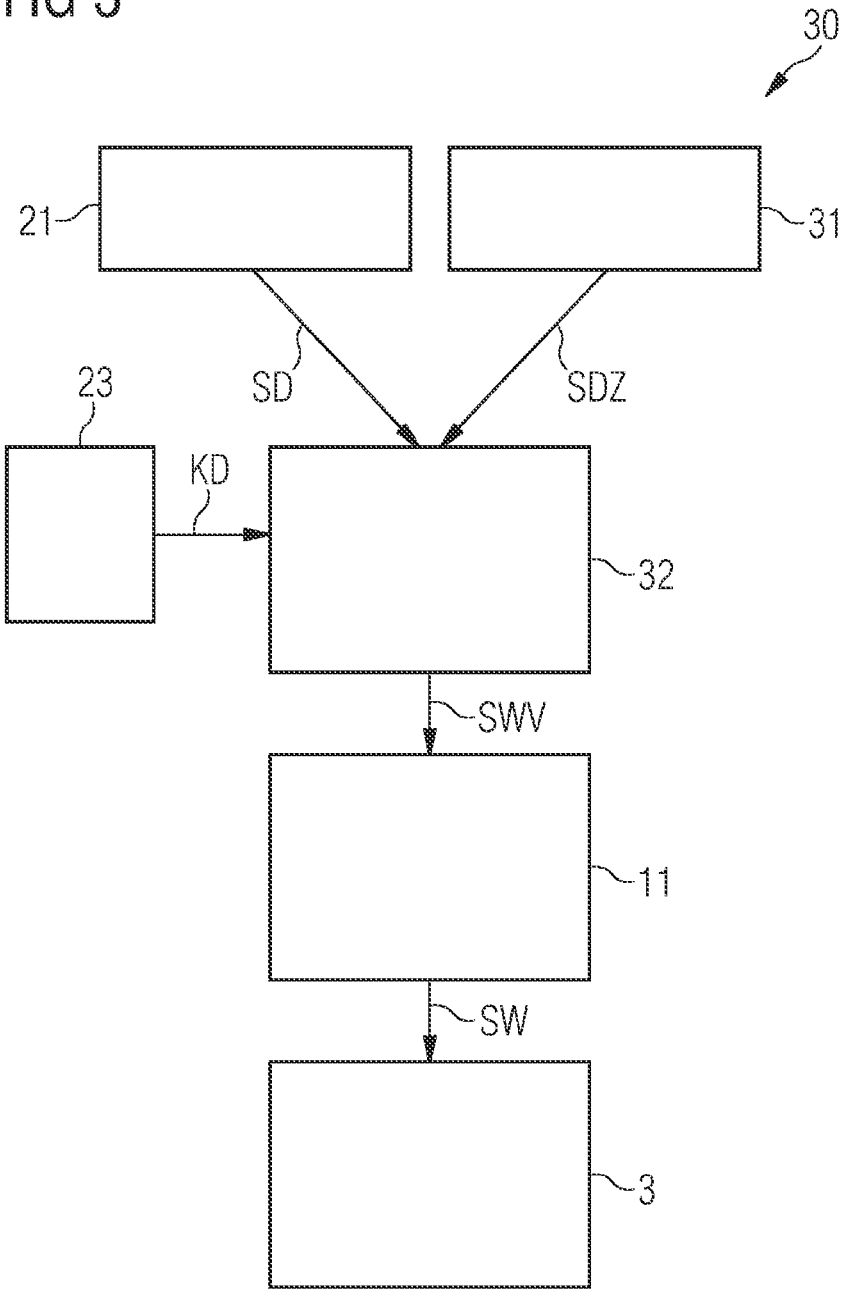
FIG. 3 shows a schematic representation of an automated on-vehicle rail vehicle control system according to a second exemplary embodiment of the invention.

FIG. 3 shows a schematic representation of an automated on-vehicle rail vehicle control system 30 according to a second exemplary embodiment of the invention. The on-vehicle rail vehicle control system 30 shown in FIG. 3 differs from the on-vehicle rail vehicle control system 20 shown in FIG. 2 in that it has additional sensors 31 for the acquisition of information from the environment. The additional sensors comprise imaging systems and radar for signal identification, for the perception of other traffic participants, for the perception of obstacles in the track region and for the perception of passengers at stops. Furthermore, the on-vehicle rail vehicle control system 30 shown in FIG. 3 differs from the on-vehicle rail vehicle control system 20 shown in FIG. 2 in a setpoint value specification determination unit 32, which evaluates the additional sensor information SDZ acquired and incorporates it the determination of setpoint value specifications SWV. In this way, the rail vehicle can also move safely in a non-secured and open region. The functions of other units, such as, for example, the database 23, the automated train operating system 11 as well as the actuation unit 3 for propulsion and braking do not differ from the units of the same name illustrated in FIG. 2 and will therefore not be described again in detail in connection with FIG. 3.

Figure 4:
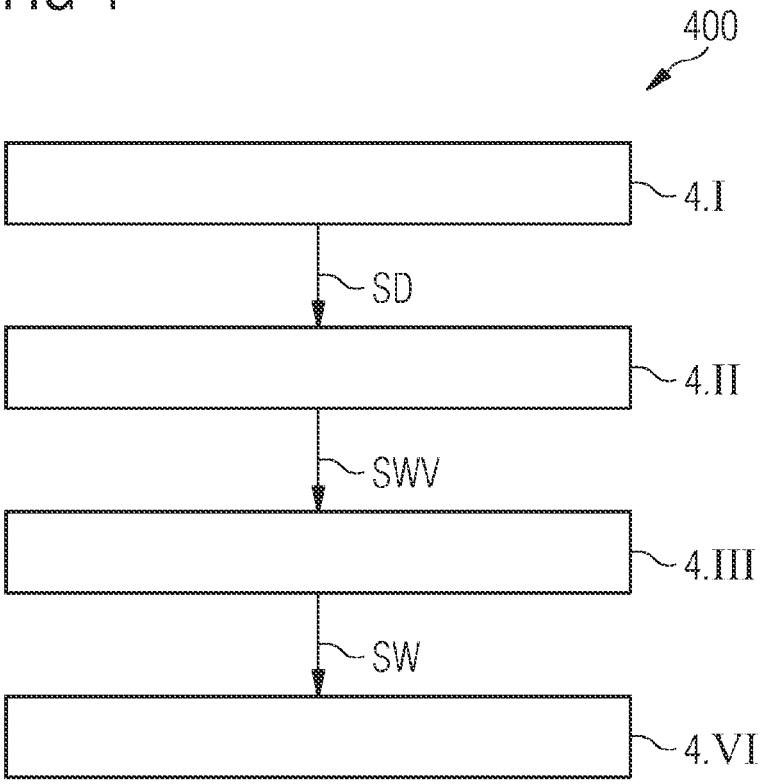
FIG. 4 shows a flow diagram illustrating a method for the automated control of a rail vehicle according to an exemplary embodiment of the invention.

FIG. 4 shows a flow diagram 400 illustrating a method for the automated control of a rail vehicle according to an exemplary embodiment of the invention. In step 4.I, there is initially an on-vehicle identification of the environment of the rail vehicle. Furthermore, in step 4.II, setpoint specifications SWV for the regulation mode and the driving mission of the rail vehicle are determined on the basis of the identification of the environment. Subsequently, in step 4.III driving and braking commands SW are generated for compliance with the driving mission determined on the basis of the setpoint value specifications SWV of the on-vehicle setpoint value specification determination unit. Finally, in step 4.IV, traction and braking operations are performed on the basis of the driving and braking commands SW determined.

In conclusion, reference is made once again to the fact that the described methods and apparatuses are only preferred exemplary embodiments of the invention and that the invention can be varied by the person skilled in the art without departing from the scope of the invention insofar as this is specified by the claims. It is also pointed out for the sake of completeness that the use of the indefinite article "a" or "an" does not preclude the possibility of the features in question also being present on a multiple basis. Likewise, the term "unit" does not preclude the possibility of this consisting of a plurality of components which may also be spatially distributed.

The invention claimed is:

1. An automated on-vehicle rail vehicle control system, comprising:

an on-vehicle setpoint value specification determination unit;

an automated train operating system;

a driving and braking unit; and a plurality of sensors for acquiring environmental information;

said on-vehicle setpoint value specification determination unit being configured, based on a high-precision on-vehicle position determination and high-precision map data, and based on dynamic influences identified from environmental information acquired via sensor data from said sensors, to determine operative setpoint value specifications for a regulation mode and a current driving mission of the rail vehicle, in order to move the rail vehicle according to the driving mission and an external environmental situation;

said automated train operating system being configured to generate driving and braking commands based on the setpoint value specifications determined by said on-vehicle setpoint value specification determination unit; and said driving and braking unit being configured to carry out traction and braking operations based on the driving and braking commands generated by said automated train operating system.

2. The control system according to claim 1, wherein said on-vehicle setpoint value specification determination unit comprises at least one of the following sensors:

a position determination unit;

an incremental odometer;

an imaging system, a radar system; and inertial sensors.

3. The control system according to claim 1, wherein said on-vehicle setpoint value specification determination unit comprises a comparison unit for comparing sensor information acquired with said sensors with a high-precision route map.

4. The control system according to claim 3, wherein the high-precision route map comprises information selected from the group consisting of a course of the route, signal positions, stop positions, and branches.

5. The control system according to claim 2, wherein said sensors have at least one imaging system or a radar system and the information from the imaging system or the radar system is usable to determine the following information:

signal identification;

perception of other traffic participants; and perception of passengers at a stop in order to carry out an appropriate procedure at the stop.

6. The control system according to claim 1, wherein a current specification for moving the rail vehicle is determined on a basis of a current local position, the driving mission, and the high-precision map data.

7. A rail vehicle, comprising an automated on-vehicle rail vehicle control system according to claim 1.

8. A method for an automated control of a rail vehicle, the method comprising the following steps:

determining a position of the rail vehicle with an on-vehicle high-precision position determination;

acquiring environmental information;

determining operative setpoint specifications for a regulation mode and a current driving mission of the rail vehicle based on the position of the rail vehicle, high-precision map data, and dynamic influences identified on a basis of the environmental information, in order to move the rail vehicle according to a driving mission and an external environmental situation;

generating driving and braking commands based on the setpoint specifications; and carrying out traction and braking operations based on the driving and braking commands.

9. A non-transitory computer program product comprising a computer program to be loaded directly into a memory unit of a control device of a rail vehicle, the computer program having program sections for performing the steps of the method according to claim 8 when the computer program is executed in the control device.

10. A non-transitory computer-readable medium on which program sections to be executed by a computer unit are stored and the program sections are configured to carry out all the steps of the method according to claim 8 when the program sections are executed by the computer unit.

* * * * *